US006948917B1

(12) United States Patent
Carrens

(10) Patent No.: US 6,948,917 B1
(45) Date of Patent: Sep. 27, 2005

(54) VALVING SYSTEM FOR A DOWNHOLE HYDRAULICALLY ACTUATED PUMP

(76) Inventor: Donald Carrens, 5912 S. Richmond, Tulsa, OK (US) 74135

( * ) Notice: Subject to any disclaimer, the term of this patent is extended or adjusted under 35 U.S.C. 154(b) by 307 days.

(21) Appl. No.: 10/385,328

(22) Filed: Mar. 10, 2003

(51) Int. Cl.[7] ..... F04B 17/00; F01L 25/02; F01L 31/02; E21B 33/03

(52) U.S. Cl. ..... 417/391; 417/392; 91/287; 91/352; 166/68

(58) Field of Search ..... 417/391, 60, 58, 417/510, 554, 392; 91/281, 287, 352; 166/68

(56) References Cited

U.S. PATENT DOCUMENTS

| | | | | | |
|---|---|---|---|---|---|
| 1,828,857 | A | * | 10/1931 | Coberly | 417/391 |
| 2,081,223 | A | | 5/1937 | Coberly | 103/46 |
| 2,631,541 | A | | 3/1953 | Dempsey | 103/46 |
| 2,787,961 | A | | 4/1957 | Chenault | 103/46 |
| 2,843,046 | A | * | 7/1958 | Knowles | 417/264 |
| 2,921,531 | A | | 1/1960 | Brennan et al. | 103/46 |
| 2,949,857 | A | | 8/1960 | Coberly | 103/46 |
| 3,109,379 | A | | 11/1963 | English | 103/46 |
| 3,118,382 | A | | 1/1964 | English | 103/46 |
| 3,374,746 | A | | 3/1968 | Chenault | 103/46 |
| 3,502,028 | A | | 3/1970 | Cooper | 103/46 |
| 3,653,786 | A | | 4/1972 | McArthur et al. | 417/404 |
| 3,865,516 | A | | 2/1975 | Roeder | 417/403 |
| 4,076,458 | A | | 2/1978 | Jones | 417/46 |
| 4,202,656 | A | | 5/1980 | Roeder | 417/88 |
| 4,406,598 | A | | 9/1983 | Walling | 417/404 |
| 4,534,168 | A | * | 8/1985 | Brantly | 60/369 |
| 4,544,335 | A | | 10/1985 | Roeder | 417/401 |
| 4,611,974 | A | * | 9/1986 | Holland | 417/388 |
| 4,768,589 | A | | 9/1988 | Roeder | 166/68.5 |
| 4,925,374 | A | * | 5/1990 | Carrens | 417/403 |
| 5,104,296 | A | | 4/1992 | Roeder | 417/403 |
| 5,209,651 | A | | 5/1993 | Kelleher et al. | 417/404 |
| 5,494,102 | A | | 2/1996 | Schulte | 166/105.6 |
| 5,651,664 | A | | 7/1997 | Hinds et al. | 417/172 |
| 5,667,364 | A | | 9/1997 | O Mara et al. | 417/151 |

* cited by examiner

*Primary Examiner*—Timothy S. Thorpe
*Assistant Examiner*—Timothy P. Solak
(74) *Attorney, Agent, or Firm*—Head, Johnson & Kachigian

(57) ABSTRACT

An engine for actuating a hydraulic downhole pump having a piston vertically reciprocated in a cylinder includes a reversing valve carried with the power piston and serving, when in a first position, to direct fluid flow to force the piston upwardly and in a second position to provide bypass fluid flow to cause the piston to move downwardly. A pilot valve carried by the power piston and serving, when in a lower position, to direct fluid flow to move the reversing valve from the first to the second position. A probe is configured to move the pilot valve to the lower position when the piston reaches an upper limit of travel.

11 Claims, 15 Drawing Sheets

VALVING SYSTEM FOR A DOWNHOLE HYDRAULICALLY ACTUATED PUMP

CROSS REFERENCE TO RELATED APPLICATIONS

This application is not related to any pending United States or international patent application.

FEDERALLY SPONSORED RESEARCH

This application is not involved in any federally sponsored research or development.

REFERENCE TO MICROFICHE APPENDIX

This application is not referenced in any Microfiche Appendix.

BACKGROUND OF THE INVENTION

Underground reservoirs of petroleum hydrocarbons are tapped by drilling wells from the earth's surface to penetrate, producing formations. Liquid hydrocarbons, or crude oil, may be forced to the earth's surface by formation pressure when a well is first drilled. However, when the formation pressure is insufficient to force the crude oil to the earth's surface, either due to an inherent low formation pressure or when a formation had been produced for an extended period of time such that its pressure has diminished, it is then necessary to pump the crude oil to the earth's surface. Oil wells are traditionally pumped using a sucker rod pump in which actuated by a string of sucker rods extending from the earth's surface. Vertical reciprocation causes constant reversal of stresses in an oil well pumping system resulting in fairly high wear rates. Further, when a well is exceptionally deep, such as 5,000 ft. or greater, problems associated with reciprocating sucker rods are greatly intensified.

One system that has been developed to produce crude oil from a deep well is by the use of hydraulically actuated pumps. The most common type of hydraulically actuated positive displacement down hole pumps employ pressure fluid that flows co-mingled back to the earth's surface with the production fluid. In some installations a separate return line is employed so that the hydraulic fluid employed for pumping action is re-circulated back to the earth's surface independently of the production fluid. However this system required parallel hydraulically operated fluid lines in addition to the production fluid passageway and the installation of this latter type of pump is more difficult. Therefore, the most common way of actuating a down hole hydraulically actuated pump utilizes the arrangement wherein power fluid is forced down central tubing to actuate a reciprocating pump engine to force production fluid into an annular area between the interior of a casing and the exterior of power tubing to the earth's surface and in which the spent power fluid is co-mingled with the production fluid. This system requires only concentric piping that is substantially easier to install and remove than parallel piping.

A typical hydraulically actuated downhole pump has a fluid powered motor, or 'engine', that produces reciprocal action and a reciprocating pump with a motor piston and a pump piston in axial alignment and connected by a piston rod. A typical pump is in the order of about 1.9 inches to 3.8 inches in diameter and from about 6.5 ft. to 25 ft. or longer and is positioned in a bottom hole assembly of a well casing. A well casing is typically in the order of about 4½ inches to 9 inches in diameter and the tubing used to supply high-pressure hydraulic fluid to actuate the pump may typically be from about 1½ inches to 3½ inches in diameter. As stated above, commingled power fluid and production fluid flows back to the earth's surface in the annual area between the interior of the casing and the exterior of the tubing.

A basic description of the operation and function of a bottom hole hydraulically actuated pump can be obtained from U.S. Pat. No. 2,081,223 entitled "Fluid Operated Deep Well Pump" that issued on May 25, 1937. This patent shows that hydraulically actuated downhole pumps have been known for at least 60 years.

Hydraulically actuated pumps must be removed periodically from a well for repair of worn parts and replacement of seals. The life of a hydraulically actuated pump depends upon many factors, a primary one being the nature of the fluid being handled, that is, whether the fluid is inherently corrosive and also upon where the production fluid carries entrained abrasive components, such as sand. Systems have been developed wherein the pump can be removed from a bottom hole location by the application of hydraulic fluid pressure. This eliminates the need for inserting a retrieval tool into the power fluid supply tubing for attachment to the upper end of the hydraulically actuated pump to physically remove the pump. The pump of the present disclosure is particularly adaptable for hydraulic removal. To remove a pump hydraulically, such as the pump described herein. fluid pressure is imposed in the annulus area, that is within the casing and exterior of the power supply tubing so that pressure is applied below the pump to force the pump upwardly within the power supply tubing to the earth's surface.

In order to obtain more pumping power, especially for operations at greater depths, multiple engine pumps have been developed. For an example of a multi-engine pump reference may be had to U.S. Pat. No. 3,653,786 entitled "Fluid Operated Pump Assembly With Tandem Engine" issued Apr. 4, 1972. In a pump of this design two fluid operated motors are positioned in tandem, one above the other with the motor pistons connected by an axial in-line piston rod. Some dual engine configurations require porting to the exterior of the pump to provide fluid paths around various components while other multi-engine pumps use internally ported arrangements. While the invention herein is described as it is applied to a single piston engine the invention can be combined with multiple engine or multiple pump systems.

For more background information reference may be had to the following previously issued United States patents:

| U.S. Pat. No. | INVENTOR | TITLE |
|---|---|---|
| 2,081,223 | C. J. Coberly | Fluid Operated Deep Well Pump |
| 2,631,541 | O. E. Dempsey | Hydraulic Pump |
| 2,787,961 | R. L. Chenault | Subsurface Hydraulic Pump Installation |
| 2,921,531 | J. R. Brennan, et al. | Pressure Fluid-Operated Pump Structure |
| 2,949,857 | C. J. Coberly | Fluid Operated Pump With Separate Engine Valve |
| 3,109,379 | C. L. English | Subsurface Pump |
| 3,118,382 | C. L. English | Subsurface Pumping Unit |
| 3,374,746 | R. L. Chenault | Hydraulically Operated Subsurface Motor And Pump Combination |
| 3,502,028 | R. F. Cooper | Hydraulic Motor And Pump |
| 3,653,786 | R. F. McArthur, et al. | Fluid Operated Pump Assembly With Tandem Engines |

-continued

| U.S. Pat. No. | INVENTOR | TITLE |
|---|---|---|
| 3,865,516 | G. K. Roeder | Fluid Actuated Down-Hole Pump |
| 4,076,458 | R. L. Jones | Automatic Pump Speed Controller |
| 4,202,656 | G. K. Roeder | Downhole Hydraulically Actuated Pump With Jet Boost |
| 4,406,598 | J. R. Walling | Long Stroke, Double Acting Pump |
| 4,544,335 | G. K. Roeder | Piston and Valve Assembly |
| 4,768,589 | G. K. Roeder | Downhole Hydraulic Actuated Pump |
| 4,925,374 | D. E. Carrens | Down Hole Hydraulically Actuated Pump |
| 5,104,296 | G. K. Roeder | Engine End For A Downhole Hydraulically Actuated Pump Assembly |
| 5,209,651 | J. M. Kelleher, et al. | Multiple Engine Deep Well Pump |
| 5,494,102 | W. H. Schulte | Downhole Hydraulically Operated Fluid Pump |
| 5,651,664 | A. C. Hinds, et al. | "Free" Coil Tubing Downhole Jet Pump Apparatus And Method |
| 5,667,364 | D. P. O Mara, et al. | Downhole Hydraulic Pump Apparatus Having A "Free" Jet Pump And Safety Valve Assembly And Method |

BRIEF SUMMARY OF THE INVENTION

The invention herein provides a hydraulically actuated downhole pump responsive to hydraulic pressure from fluid supply tubing that extends from the earth's surface, the pump having a piston vertically reciprocal in a cylinder with valving to force fluid from an underground formation to the earth's surface upon upward movement of the piston and valving to permit fluid bypass as the piston moves downwardly in the cylinder. The pump includes a reversing valve, as a part of an engine pump piston, having a first and second position and wherein in the first position a flow channel is opened to direct fluid pressure from the fluid supply tubing to force the piston upwardly in the cylinder. In its second position the reversing valve opens a flow channel to cause the piston to move downwardly.

An overall object of the invention is to provide the combination of a pilot valve and a reversing valve in which the reversing valve is hydraulically actuated to move from its first to its second position in response to hydraulic fluid pressure controlled by the pilot valve.

One object of the invention is to provide an improved pilot valve carried with the pump piston and moveable to an upper and a lower position. The pilot valve controls flow passageways to hydraulically move the reversing valve from its first to its second position.

Another object of the invention is to provide an improved actuator probe within the pump upper portion which is arranged to move the pilot valve from its upper to a lower position when the pump piston reaches the top end of its stroke and to cause the reversing valve to move from it's first to a second position to thereby reverse the direction of travel of the pump piston downwardly. Provision is made to provide a hydraulic shock absorbing means to prevent substantial metal to metal contact of the pilot valve with the actuator probe.

A further object of the invention is an improved arrangement of the reversing valve's spool that more effectively employs hydraulic pressure to move the valve from its second position back to its first position when the pump piston reaches the lower end of its stroke.

Another object of the present invention to provide a hydraulically actuated down hole pump including an improved valving system.

A better understanding of the invention will be obtained from the following detailed description of the preferred embodiment and the claims taken in conjunction with the attached drawings.

BRIEF DESCRIPTION OF THE DRAWINGS

FIGS. 2A through 2G show the relationship of the pump components when the pump piston is moving in the downward direction.

DETAILED DESCRIPTION OF A PREFERRED EMBODIMENT

Although reference herein may be made only to FIGS. 1A to 1G, it is understood that like numerals for like parts will appear in FIGS. 2A to 2G.

Figure 1A:
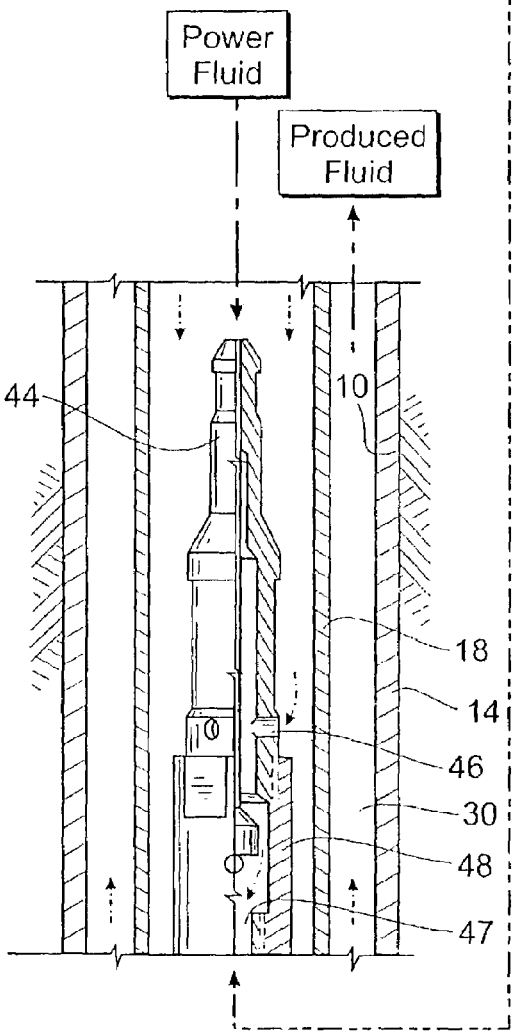
FIGS. 1A through 1G are elevational views of a preferred embodiment of the invention showing the relationship of the pump components as the pump piston is in the upstroke mode. The pump shown in some of the views such as FIGS. 1A and 1B are shown partially in elevational view and partially in cross-sectional view, whereas in FIGS. 1C through 1G the pump is shown in full cross-sectional view.
Figure 1B:
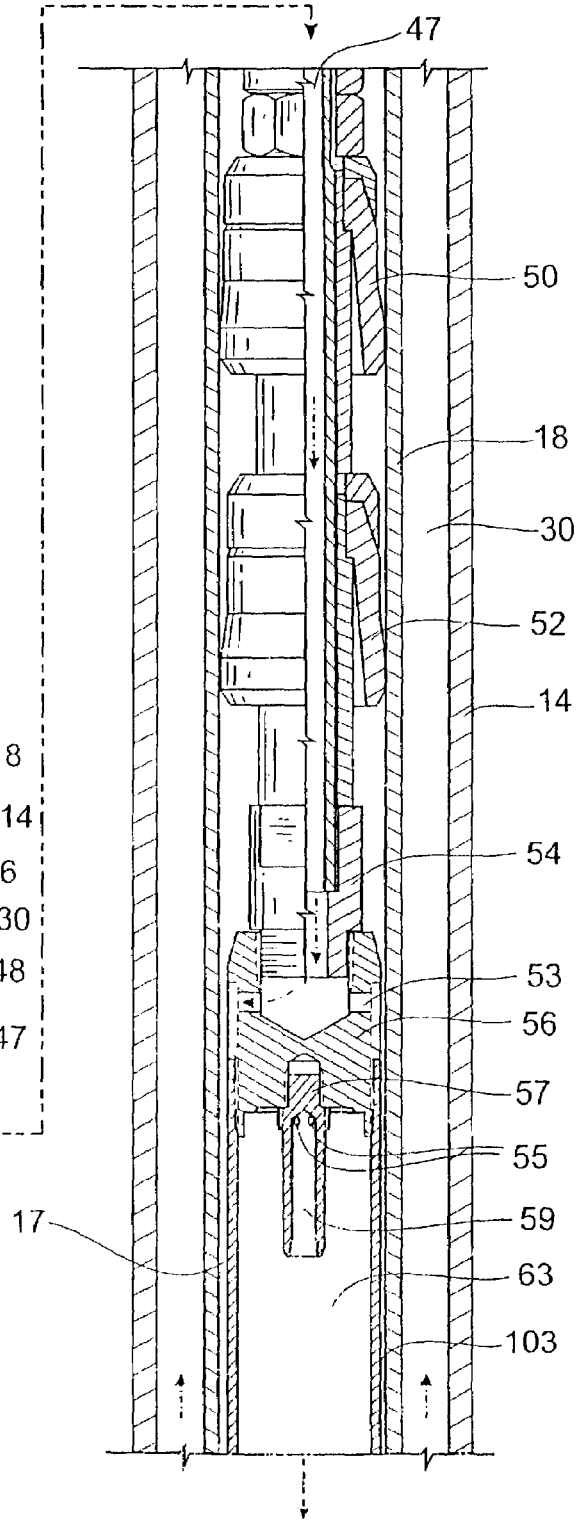
Figure 1C:
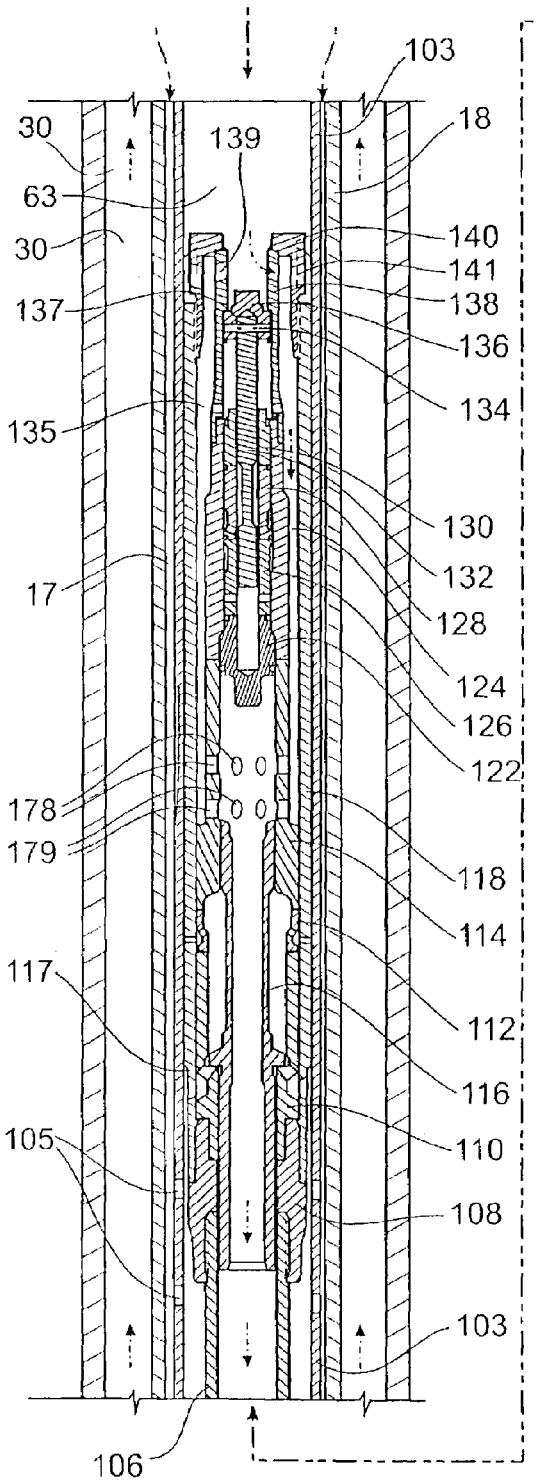
Figure 1D:
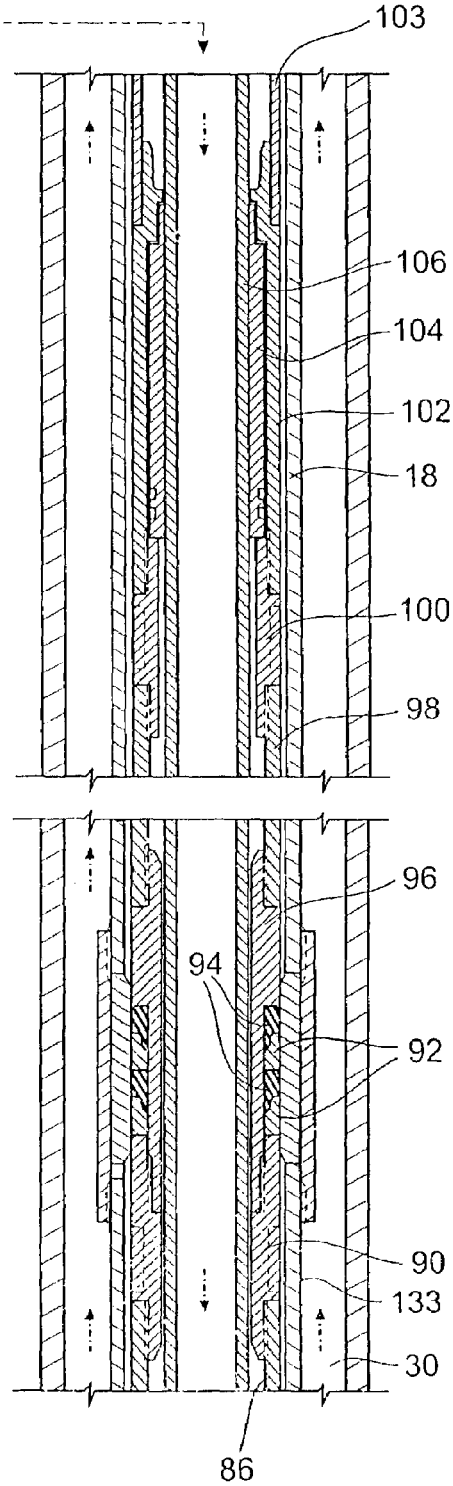
Figure 1E:
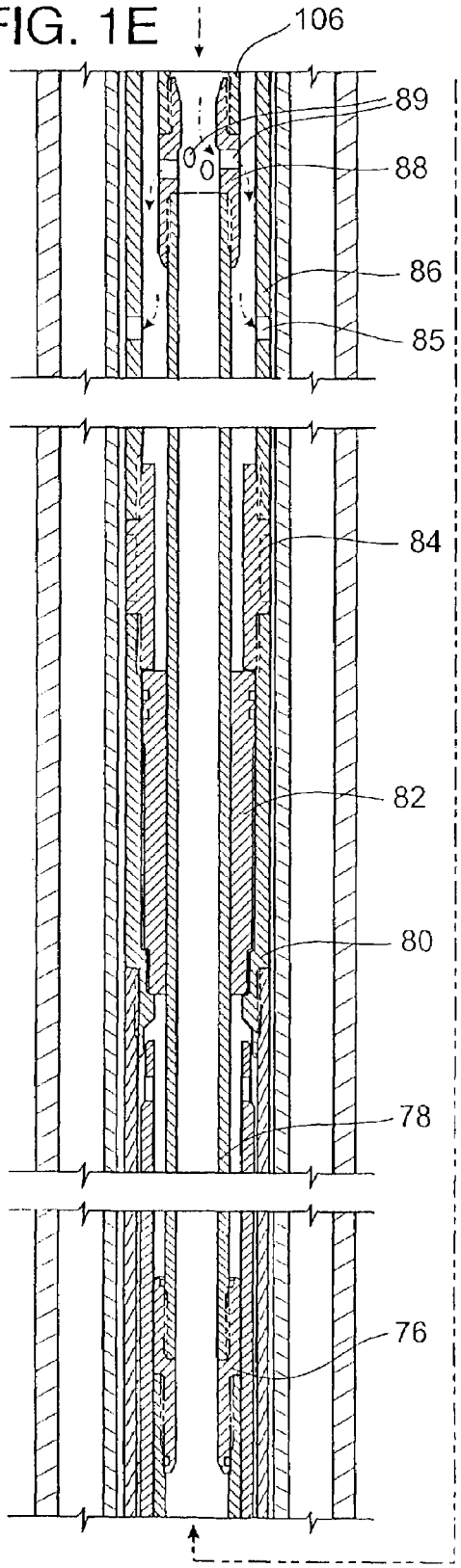
Figure 1F:
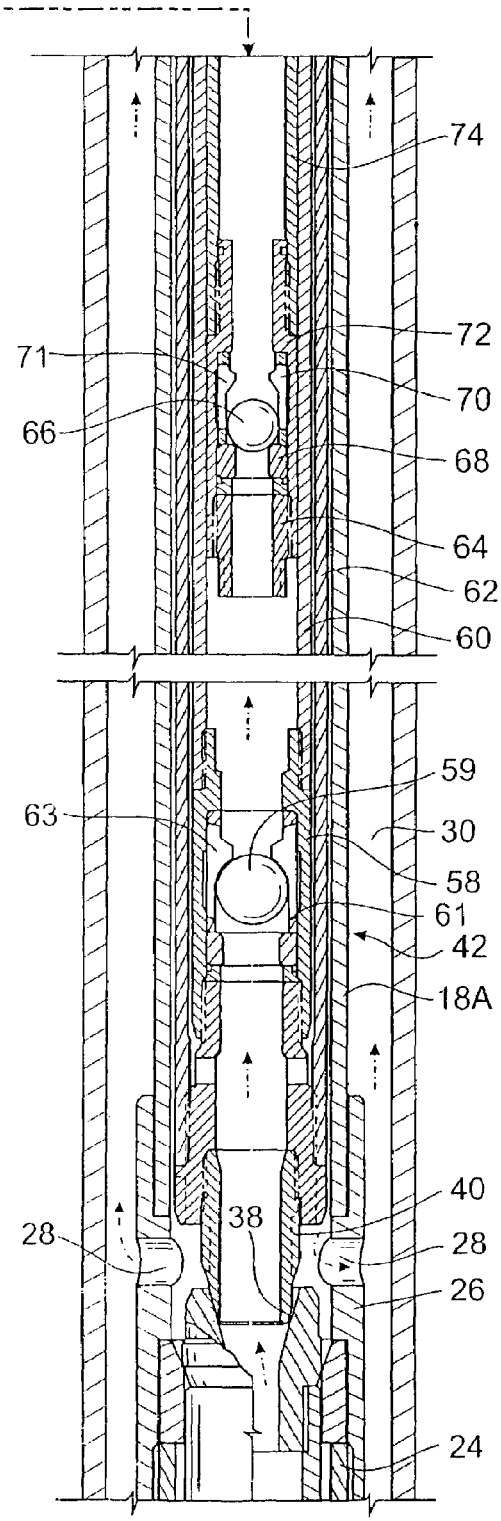
Figure 1G:
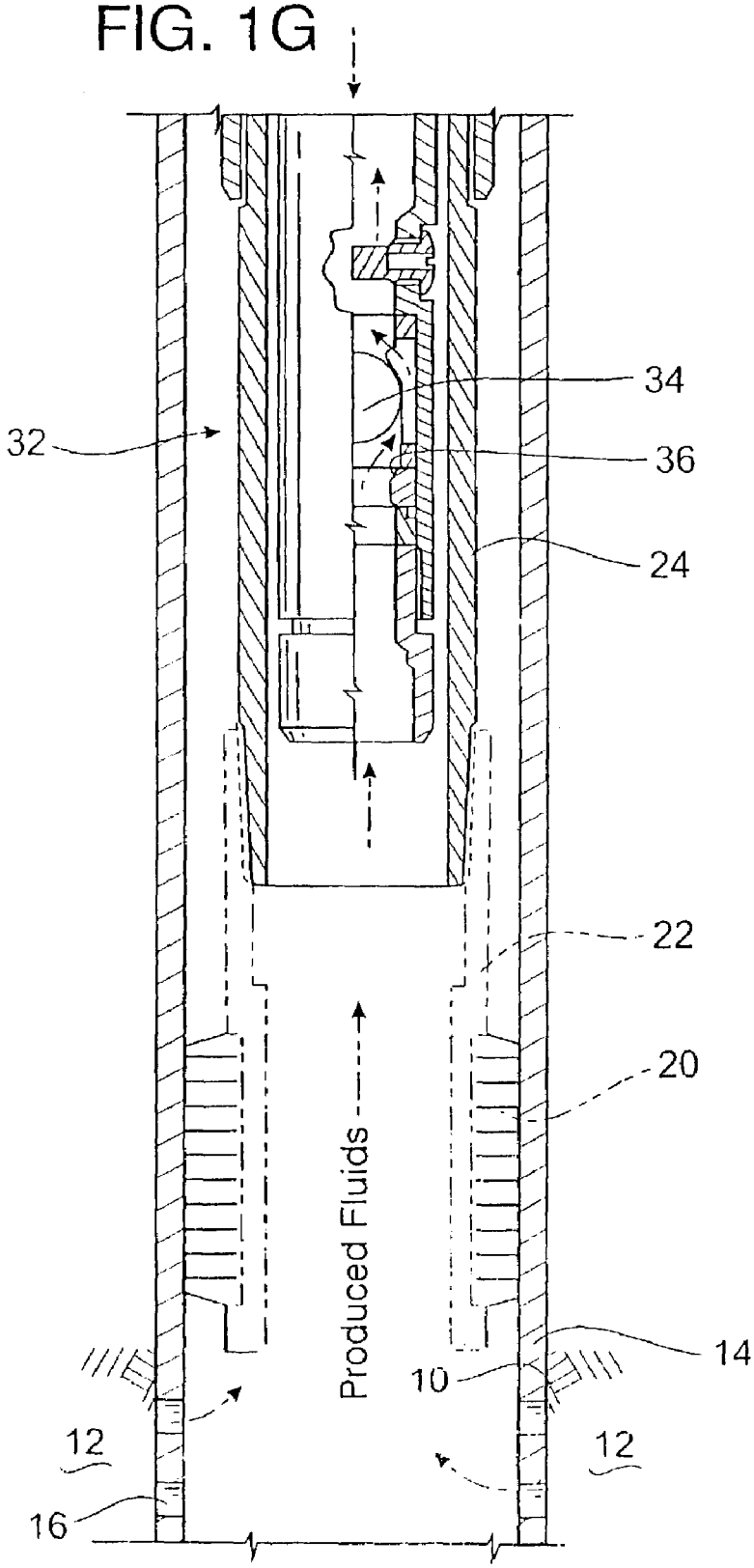

Referring first in FIGS. 1A through 1G there is shown a downhole hydraulically actuated positive displacement pump according to this invention, the pump being shown as located in the bottom of an oil well. An oil well is formed when a borehole 10 is drilled from the earth's surface into a producing formation. Borehole 10 is illustrated in only FIGS. 1A and 1G but it is understood that the borehole extends in all the area in which sections of the pump of this invention are illustrated. The borehole 10 penetrates a hydrocarbon producing formation 12 (see FIG. 1G) having liquid hydrocarbon or crude oil therein. Placed in borehole 10 is a string of casing, that is, steel pipe 14 that extends from the earth's surface (not shown) into or adjacent producing formation 12. The casing 14 in the producing formation is perforated, that is provided with openings 16, as seen in FIG. 1G, so that fluid from producing formation 12 may flow into the lower end of the casing. As has been previously been stated, when a producing formation 12 is first penetrated there may be sufficient underground formation pressure to force produced fluids to the earth's surface in some geographical areas of the world. In this case the well is considered a "flowing" well and no pumping facility is required. However, in many parts of the world the subterranean or formation pressure is not sufficient to force produced crude oil to the earth's surface and therefore a pumping system is required. In some cases. after an initial flowing, the formation pressure subsides, or the formation is initially insufficient to force produced crude oil to the earth's surface. In such cases another form of pumping system is required.

Thus, the objective of this invention is to provide a system for forcing crude oil that enters into casing 14, through perforation 16, to the earth's surface. Also as previously stated, one means of lifting hydrocarbon to the earth's surface is by means of a sucker rod reciprocated pump. However this invention is directed to a completely different pumping system in which fluid is produced hydraulically. For this purpose there is installed within casing 14 a string of power fluid tubing 18 that extends from a high pressure power fluid source at the earth's surface to the producing formation. As shown in FIG. 1G, there is seated within casing 14 packer 22 and packing 20, shown diagrammatically. Positioned within packer 22 is a seating nipple 24. The upper end of the seating nipple 24 has attached to it a perforated coupling 26 (see FIGS. 1F and 2F) having openings 28 therein through which produced fluid and spent power fluid may flow to the surface from the pump into the annulus area 30 that exists between the exterior of the power fluid tubing 18 and its lower spacer tube 18A and the interior of casing 14. A standing valve assembly generally indicated by the numeral 32 in FIG. 1G includes a ball valve 34 and seat 36. Ball valve 34 lifts off of seat 36 to permit production fluid to flow upwardly there through from within the interior of casing 14. Extending upwardly from seating nipple 24 is the hydraulic pump of this invention. The pump is removably receivable within power fluid tubing 18. At the upper end of seating nipple 24 within perforated coupling 26 (FIG. 1F) is a seat 38. The lower end of the pump has a seating element 40 that forms a seal with seat 38 providing communication between the interior of the seating nipple 24 and a 'standing' pump ball and seat generally shown at 42.

Figure 2A:
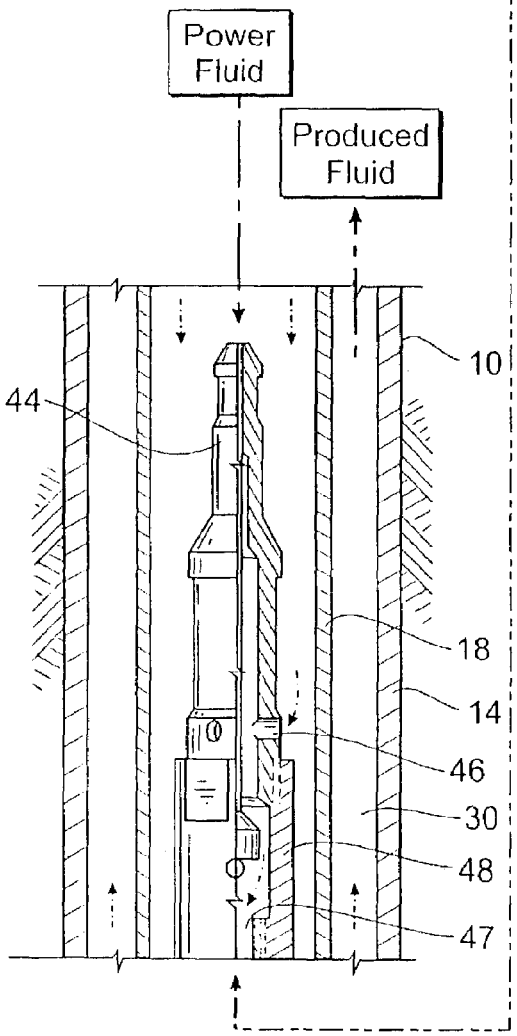
FIGS. 2A through 2G are cross-sectional view or partially cross-sectional view essentially the same as corresponding FIGS. 1A through 1G except
Figure 2B:
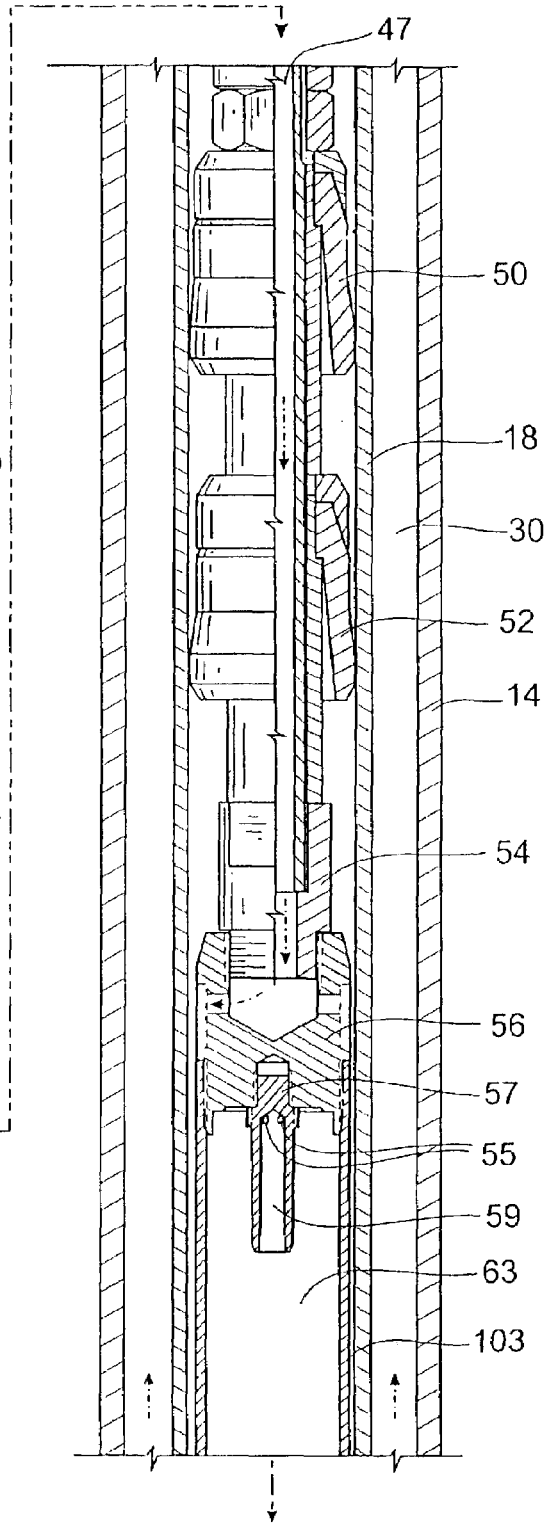

At the upper end of the pump as shown in FIG. 1A there is a wire line fishing tool and/or a retriever neck 44 having perforations 46 in the lower portion thereof that communicate with an interior passageway 47 within tubular member 48 that supports packers 50 and 52 (see FIGS. 1B and 2B). The lower end of the tubular member 48 connects to an adapter 54 that in turn is threaded into an internally threaded recess in the upper end of a pump top plug 56.

The portions described up to this point are more or less typical of hydraulically actuated positive displacement bottom hole pumps, particularly of the type that can be recirculated back to the earth's surface hydraulically and as such form background for the invention but the elements described to this point are not critical to the unique aspect of the invention.

The Pump System

Figure 2C:
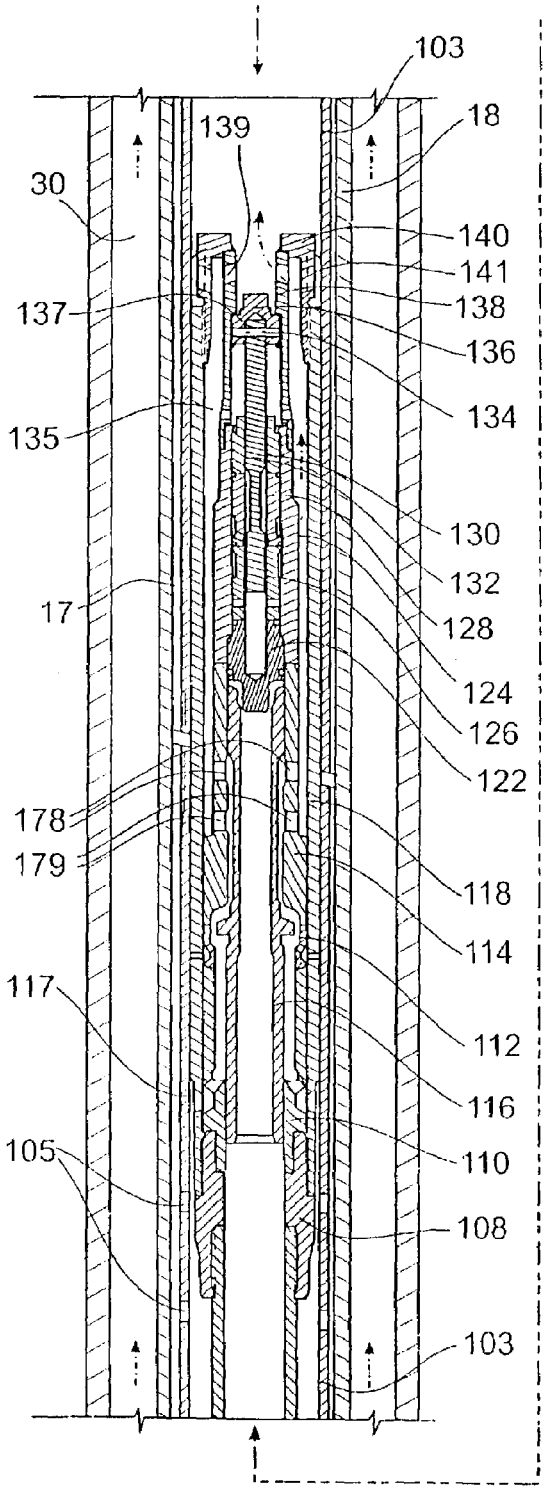
Figure 2D:
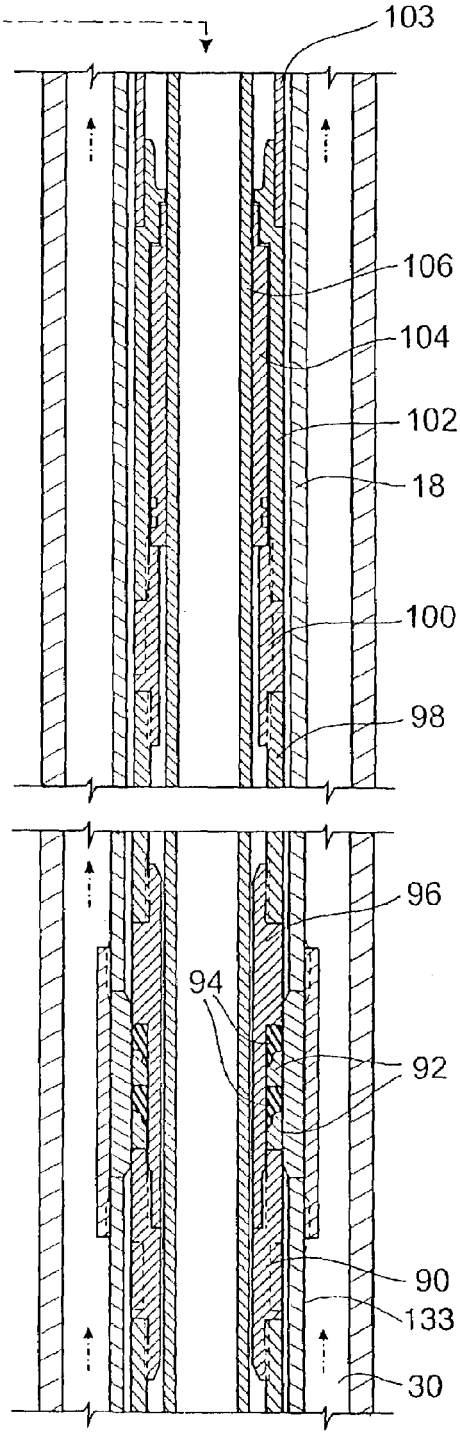
Figure 2E:
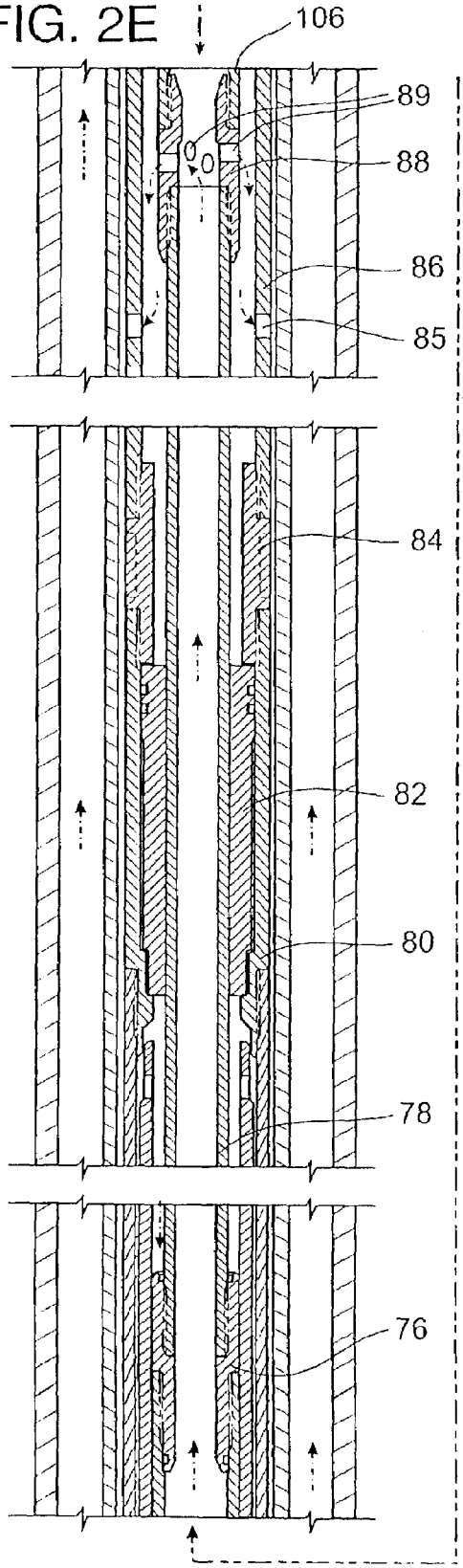
Figure 2F:
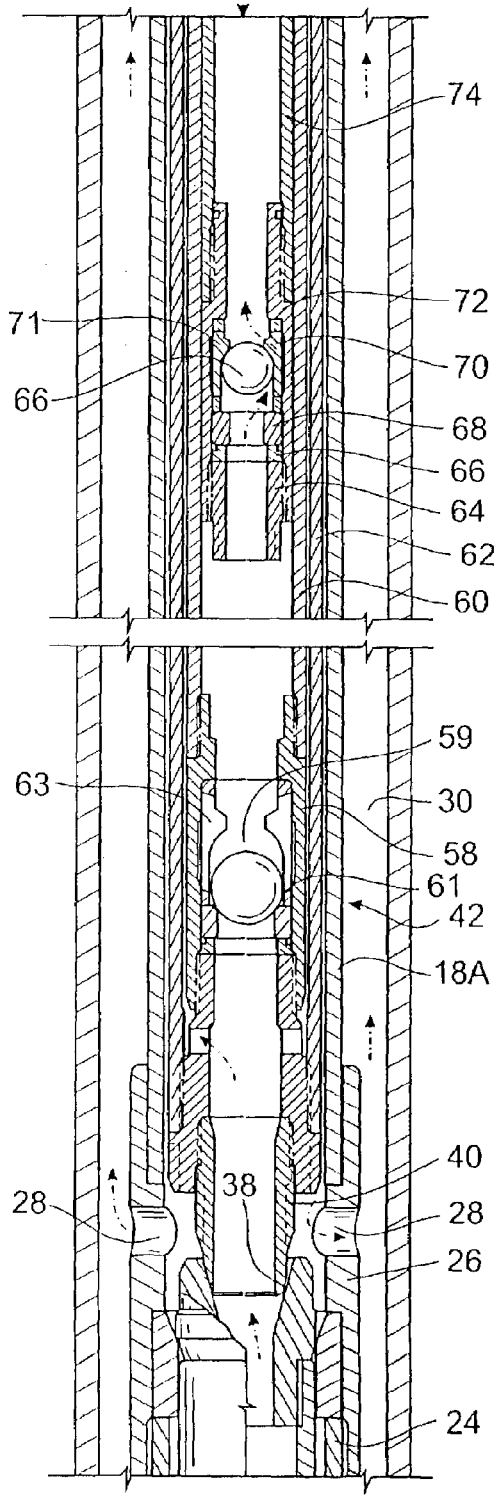
Figure 2G:
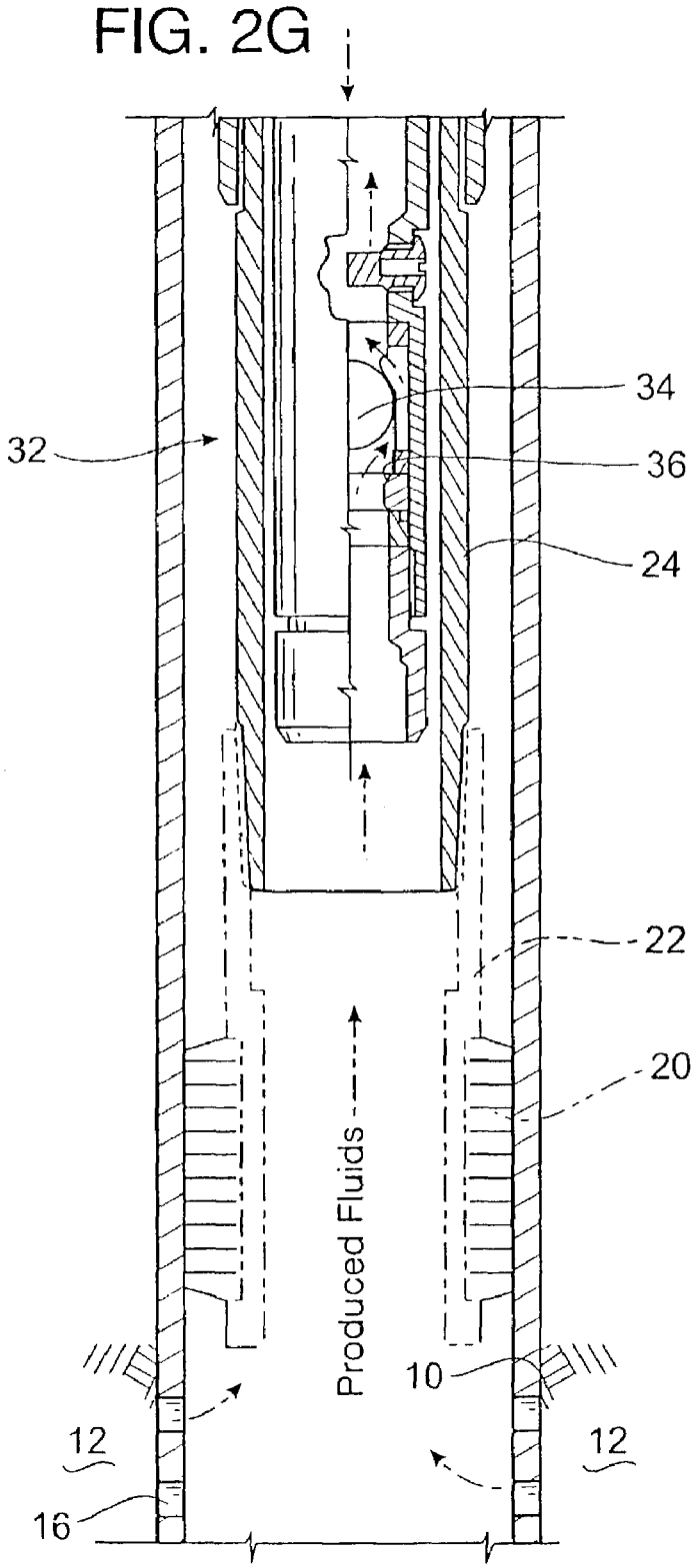

The pulp system of the invention essentially extends from the pump top plug 56 (FIGS. 1B and 2B) downwardly to the tapered seat 40 (FIGS. 1F and 2F). The pump itself, begins at the lower end thereof, as shown in FIGS. 1F and 2F, at tapered seat 40, extending to the upper end thereof to the pump top plug 56 (FIGS. 1B and 2B). Specifically, the lower end defines a cage 58 for a ball 59 and a seat 61. By-pass channels 63 permit flow of produced fluids when in the upstroke position shown in FIG. 1F, and prevent flow during the downstroke as shown in FIG. 2F. Continuing upward is a pump barrel 60; a pump jacket 62; a seat plug 64 which supports seat 68 and traveling ball valve 66 within cage 70 which also includes by-pass channels 71 for the flow of produced fluid during the downstroke as shown in FIG. 2F. A traveling valve housing 72 connects with a pump piston 74, as best shown in FIGS. 1F and 2F. Continuing upwardly, the pump structure as shown in FIGS. 1E and 2E includes: a pump piston connector 76; a pump rod 78; a pump barrel adapter 80; a pump rod sleeve 82; a sleeve retainer 84; a discharge tube 86, with ports 85, and a rod connector 88 with openings 89.

The next portion of the pump as shown in FIGS. 1D and 2D includes a lower seal retainer 90 that connects discharge tube 86 with upper seal retainer 96; a backup ring support 92 and a resilient pump seals 94.

The Engine System

The engine is the heart of the invention. Referring to FIGS. 1C and 2C and 1D and 2D, there is an upper seal retainer 96 connecting together with upper tube 98, upper sleeve retainer 100, and engine barrel adapter 102 that connects with engine barrel 103. The engine barrel 103 ultimately connects with pump top plug 56 (FIG. 1B) having the downwardly extending actuator probe 57 that is essentially closed at its upper end except for at least one flow control orifice 55 that permits fluid communication between conduit 59 and engine bore 105. Engine rod sleeve 104 (FIG. 1D) provides a close, yet slidable, precision tolerance seal bearing surface for reciprocating engine rod 106.

Finally, as seen in FIGS. 1C and 2C there is an engine rod connector 108; a lower reversing valve sleeve 110; a control ring 112; an upper reversing valve sleeve 114 which support the reciprocatable reversing, valve 116. A piston face 117 is at the lower end of an engine mandrel 118.

The Pilot Valve

FIGS. 1C and 2C, FIGS. 3 and 3A describe the remaining part of the engine which includes a pilot valve retainer 122; a pilot valve body 124; a lower pilot valve sleeve 126; a pilot valve spacer 128; an upper pilot valve sleeve 130 and a reciprocal pilot valve 132. The pilot valve is a spool type with an upper stem 132 and a lower stem 133 with a reduced neck or smaller diameter portion 135. The upper and lower stem portions controlling the flow of fluids through passageways 160–170 and 164–174. Atop the pilot valve 132 is an actuator piston 136 retained to the pilot valve by pin 134. An actuator piston guide 138 is held in place by a top engine retainer 140 with flow ports 141 that communicate with flow ports 139. The guide 138 includes as inner shoulder 137 that defines the top stroke of the actuator piston 136.

Figure 3:
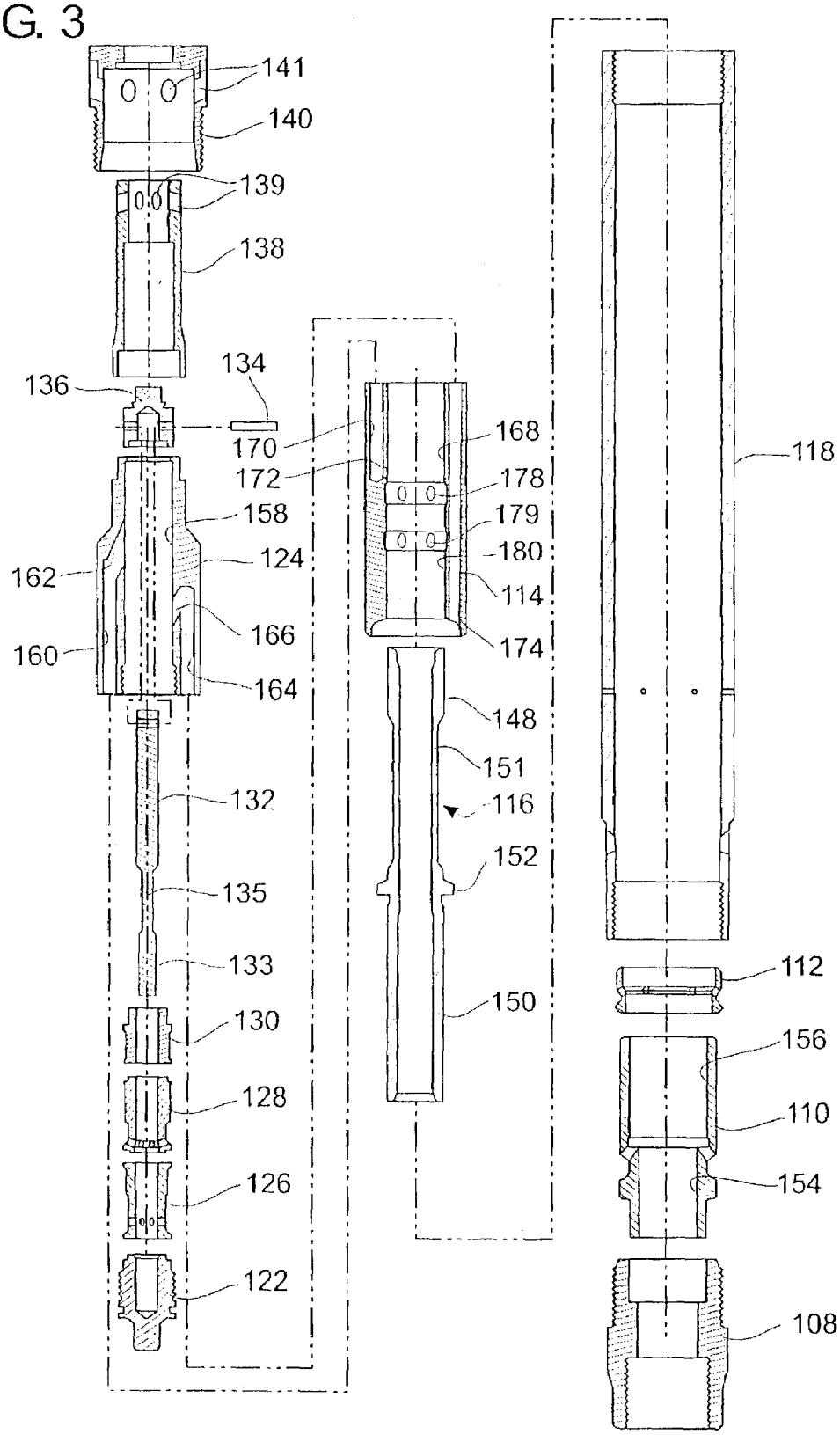
FIG. 3 is an exploded view of the engine mandrel that includes the critical elements of the present invention; that is, a pilot valve and a reversing valve.
Figure 3A:
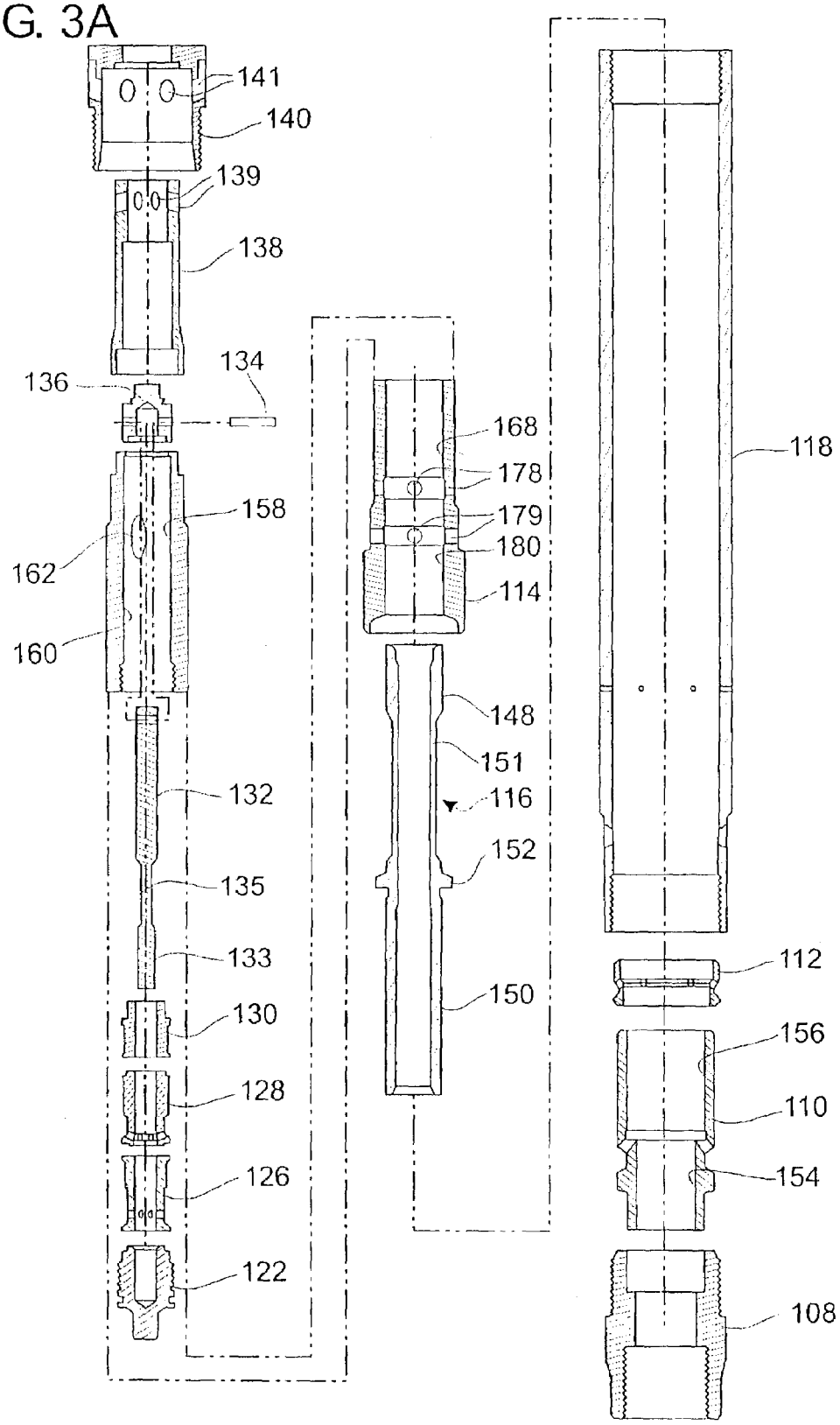
FIG. 3A is the same exploded view as in FIG. 3 with parts rotated 90°.
Figure 9:
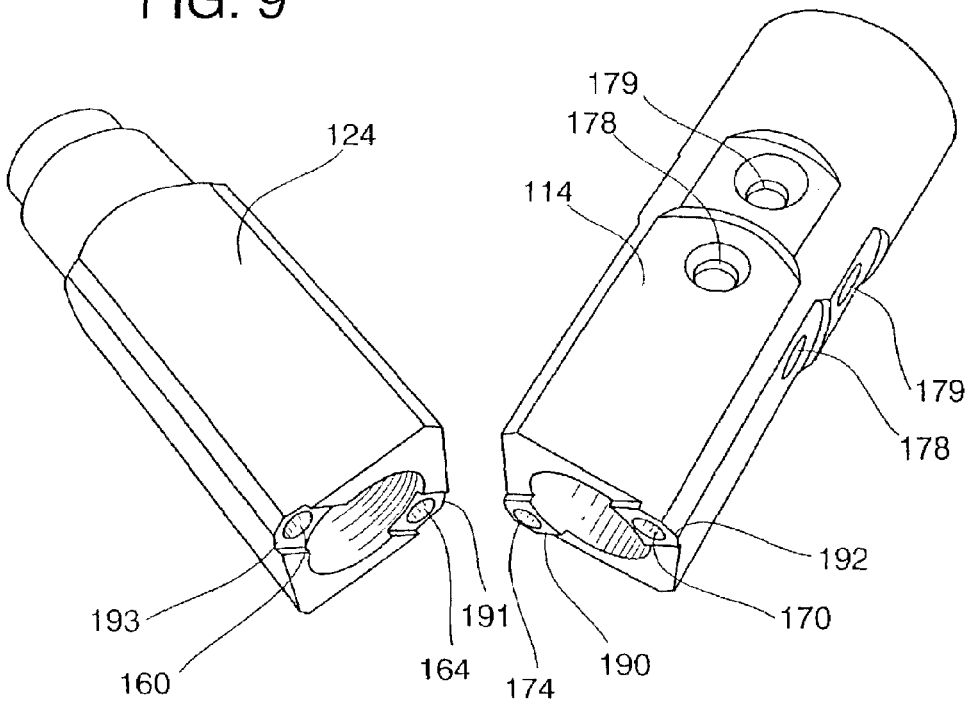
FIG. 9 is a perspective view of an embodiment showing the interlocking connection of a two piece pilot valve/reversing valve body.

As shown in FIGS. 3, 3A and FIG. 9, the pilot valve body 124 has a central passageway 158 there through. A first vertical passageway 160 extends downward from a first lateral port 162 that communicates with central passageway 168 via passageway 170 and lateral port 172 in the reversing valve sleeve 114. Opposite and below the first vertical passageway 160, a second vertical passageway 164 extends from a second lateral port 166 that also communicates with central passageway 158. Second vertical passageway 164 communicates with passageway 174 in the reversing valve sleeve 114. Fluid flow though these vertical passageways is controlled by the position of the pilot valve stem 132 and its assembled components 122, 126, 128, and 130, as shown in FIG. 4A.

The Reversing Valve System

Figure 4A:
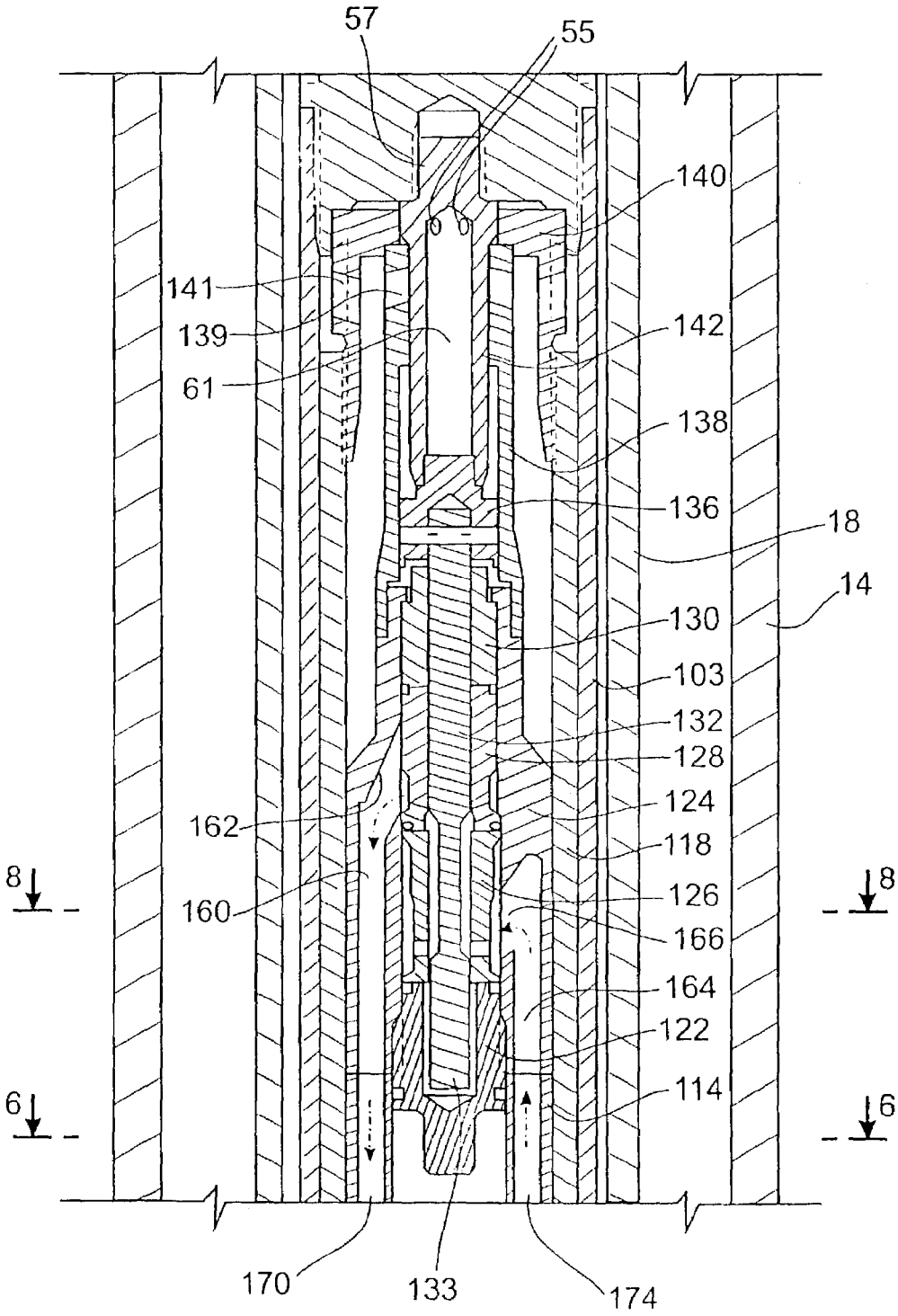
FIG. 4A is an enlarged view of an upper portion of the engine mandrel showing the pilot valve in its depressed position as occurs when the engine mandrel has moved to its upward limit of the pump stroke and in which the pilot valve is moved from an upper to a lower position to hydraulically cause the reversing valve to move from its first to its second position.
Figure 4B:
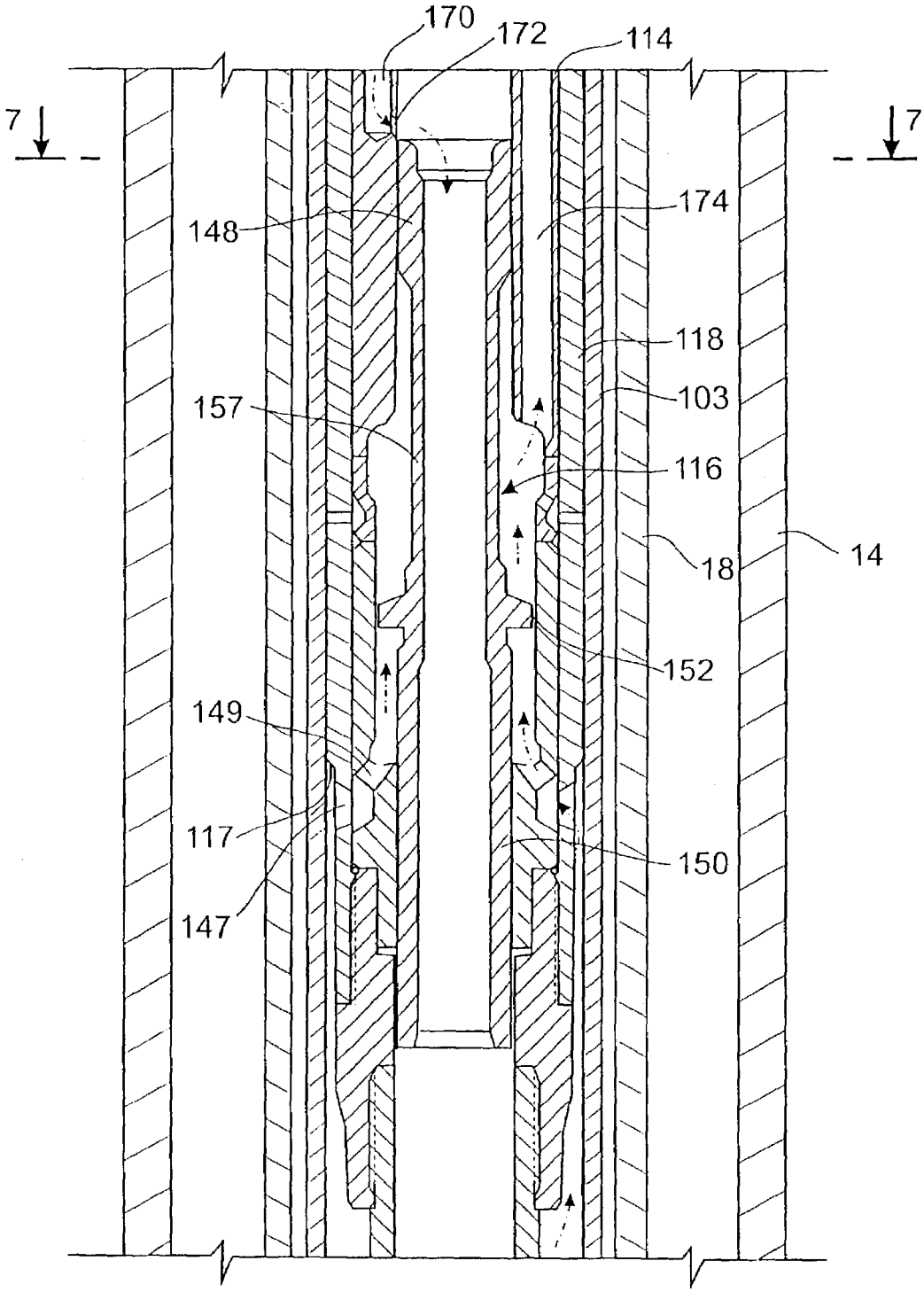
FIG. 4B is an enlarged cross-sectional view of the lower portion of the engine mandrel showing more details of the reversing valve and showing the reversing valve moving towards its second or upper position.

FIGS. 3, 3A, show, in exploded view, and FIGS. 4A and 4B, the critical components of the engine mandrel 118 that work with and control the reciprocating action of the pump system, primarily by the action of the reversing valve 116 shown generally, and the pilot valve spool 132 as they change positions to cause the pump to move reciprocally up and down and to pump production fluid to the earth's surface. The reversing valve 116 is a spool type with an upper cylindrical surface 148 and a lower stem 150 with intermediate reduced section 151 and intermediate flange 152.

Reversing valve sleeve 114 and pilot valve body 124 share non-circular external surfaces, such as being essentially square, to provide exterior flow channels 176 within the interior of engine mandrel 118. (See FIGS. 6–8 and 9).

Reversing valve sleeve 114 has a central passageway 168 extending through it. Openings 178 and 179 communicate the central passageway 168 with the annular space between sleeve 114 and engine mandrel 118. The central passageway 168 defines, in part, cylindrical surface 180 to receive the precision close tolerance cylindrical surface 148 of the reversing valve 116. As previously described first vertical passageway 170 extends from intermediate lateral passageway 172 to first lateral port 162, of the pilot valve body 124, via first vertical passageway 160. Vertical passageway 174 extends the full length of reversing valve sleeve 114 and communicates at its upper end with the pilot valve body second vertical passageway 164 and opening 166.

Figure 7:
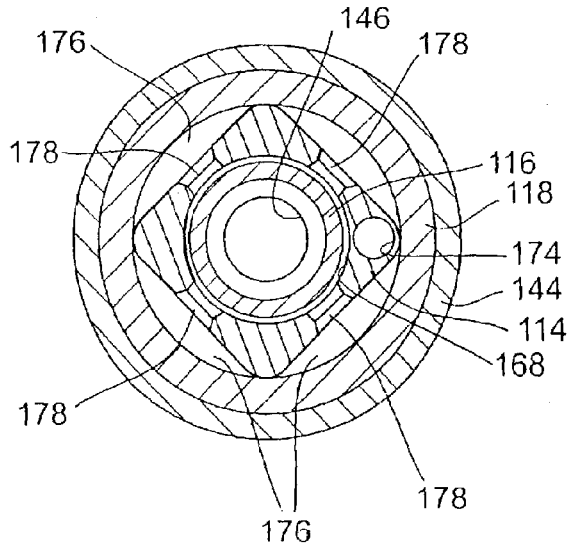
FIG. 7 is a cross-sectional view taken along the line 7—7 of FIG. 4B showing as the reversing valve upper end portion in cross-section as the reversing valve is moving to its second or upper position.

As seen in FIG. 7, lateral passageways 178 and 179(four in each being shown although there may be more or less than this number) are formed in the sidewall of reversing valve sleeve 114 communicating between central passageway 168 and external flow channels 176. Flow through lateral passageways 178 and 179 is controlled by reversing valve 116 as seen in FIGS. 1C and 2C. Arrows on the drawings show fluid flow directions for different phases of the pump action. Specifically, FIGS. 1A though 1G show flow directions when the pump is moving upwardly. FIGS. 2A through 2G show flow directions when the pump is moving downwardly.

The perspective view of FIG. 9 is provided to show one form of interconnection of pilot valve body 124 and reversing valve sleeve 114 utilizing male projections 190 and 192 that mate with respective female recesses 191 and 193. Although the pilot valve body and the reversing valve sleeve could be made as a unit, as by casting, the two piece form as shown provides easier machining operations.

Operation

The operation of the apparatus of this invention will now be described, first with regard to FIGS. 1A through 1G. which represent the position of the mechanical elements during the upstroke cycle of the engine power system. The operation is considered to be an open power fluid type which allows the exhausted power fluid to mix with the produced fluid as distinguished from a closed power fluid system which keeps the power fluid separated from the produced fluid. A surface power fluid supply system, schematically designated, continuously pumps power fluid into power fluid tubing 18 through port 46 in retriever neck 44 thence into passageway 47. As shown in FIG. 1B, flow continues outward through ports 53, in top plug 56, entering the annular space 17 between tubing 18 and engine barrel 103. Flow continues and enters ports 105 at the bottom of the engine system against the piston area 117 (essentially equal to the inside diameter of engine barrel 103) formed at the bottom of engine mandrel 118. As the engine mandrel 118 drives upwardly it pulls with it engine rod 106, rod connector 88 (FIG. 1E), pump rod 78, and pump piston 74 within pump barrel 60. This action draws produced fluid upwardly though ball valves 34 and 59 into the pump barrel 60 (FIGS. 1G and 1F). In the meantime, as shown in FIG. 1C, lower pressure fluid collected above the engine in engine barrel 103 and chamber 63, flows through ports 139, through channel 135 and ports 178 and 179 through the interior of the reversing valve 116 into the conduit of engine rod 106. Referring to FIG. 1E, flow continues outward through ports 89, commingling with produced fluids inside the annular space between rod 106 and discharge tube 86. Flow continues outward through ports 85 into the annulus between discharge tube 86 and power fluid tubing 18 and spacer tube 18A. This fluid enters the return fluid annular space 30 via ports 28 (FIG. 1F) on its way to the surface of the well.

When the pump engine reaches the upper end of its travel, it is necessary to re-direct power fluid to cause the pump piston 74 to move in the reverse or downward direction. The action that takes place when the pump piston 74 reaches the top of its travel is best illustrated in FIG. 4A. This figure shows actuator probe 142 having received actuator piston guide 138 which, in turn, has engaged actuator piston 136 and thereby downwardly displace spool type pilot valve stem 132. As shown in FIG. 4B, this momentary downward displacement of pilot valve stem 132 allows pressure fluid flow to move reversing valve 116 to its upward or second position. The downward displacement of pilot valve stem 132 directs fluid flow, as shown by the arrows in FIGS. 4A and 4B, and thereby apply hydraulic fluid pressure via port 149 to operate against flange 152 cause reversing valve 116 to move to its upward position. Once the displacement of actuator probe 142 occurs, as best shown in FIG. 4A, the continuous supply of pressure fluid now enters via ports 147 and 149 against intermediate diameter of flange 152 to force the reversing valve 116 upward. During this change of direction upwardly some power fluid can by pass the intermediate diameter 152 as shown in FIG. 4B. Power fluid continues upwardly via passageways 174 and 164 and out via opening 166 into the space created by the reduced neck portion of the pilot valve 132. Flow continues via port 162 into passageways 160 and 170 thence outward via port 172 into the center conduit of reversing valve 116. The hydraulic pressure in the center conduit is now lower than that below the reversing intermediate valve diameter 152. As a result the reversing valve will move upwardly to the position shown in FIG. 2B. This causes the fluid pressures to be applied upon the top of the engine piston 117 so that the engine piston is now forced downwardly as shown in FIGS. 2A through 2G.

As soon as the piston reverses direction and begins to move downward, the pilot valve stem 132 moves back to its upward position. The pilot valve stem 132 remains at all times in the upward position, whether the piston is moving up or down, except for the brief time that it is displaced by actuator probe 142 at the top of the engine piston upward stroke. When reversing valve 116 has been moved to its upward, or second position by the momentary displacement of pilot valve stem 132 the reversing valve 116 remains in its second position even though pilot valve stem 132 returns to its upper position as soon as the piston has moved downward far enough to remove contact between actuator piston 136 and actuator probe 142.

Figure 5:
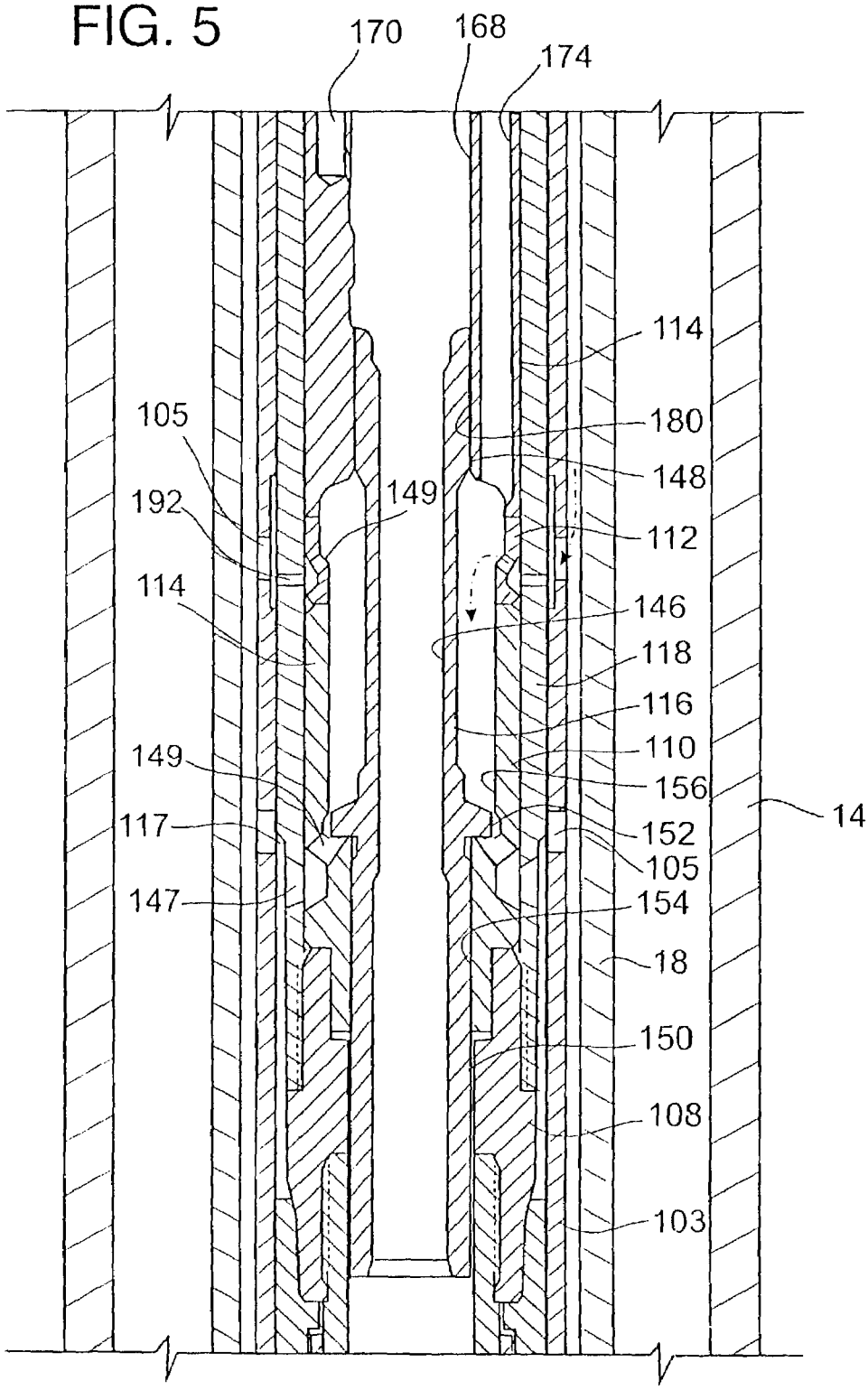
FIG. 5 is an enlarged view of a lower portion of the engine mandrel and showing the reversing valve in its first or lower position during the upstroke mode.

When the piston reaches the bottom of its stroke increased fluid pressure causes reversing valve 116 to move from its upper, second position, to its lower or first position. Note that reversing valve 116 is tubular having an open passageway 146 there through. The reversing valve 116, as seen in FIG. 5, has three important piston forming external diameters; that is, an upper diameter 148, a lower diameter 150 and an enlarged intermediate diameter 152. The lower external diameter 150 of reversing valve 116 is a precision close tolerance fit to be sealably and reciprocal within a lower internal cylindrical surface 154 of lower valve sleeve 110. The upper external cylindrical surface 148 of reversing valve 116 is also a precision fit to be sealably and reciprocally received within a cylindrical surface 180 of upper valve sleeve 114. The intermediate external diameter 152 is received in an upper cylindrical surface 156 of lower valve sleeve 110.

The movement of the reversing valve 116 back to the position shown in FIG. 5, for the upstroke, occurs from a variety of effects. The ongoing continuously applied pressure fluid creates pressure applied to the upper 148, lower 150 and enlarged 152 diameters. Because 148 is smaller than 150, the same pressure applied to both will cause the reversing valve to move downward. The fluid now collected above the engine will flow downwardly via ports 178 and 179. Flow through also passageway 17 continues via the annular space between engine barrel 103 and power fluid tubing 18 to the reversing valve sleeve 114 via ports 105, 192, and 149. Once the reversing valve 116 reaches the position shown in FIG. 5, the upstroke will begin as described.

Figure 6:
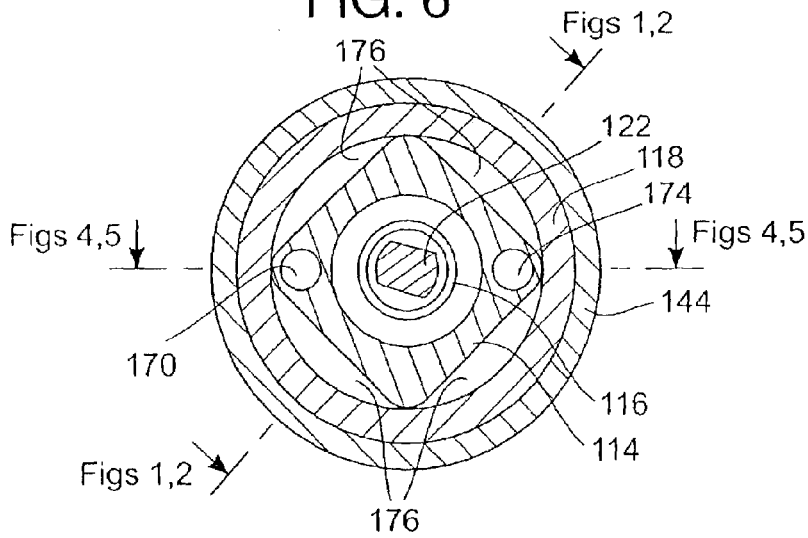
FIG. 6 is a cross-sectional view taken along the line 6—6 of FIG. 4A.
Figure 8:
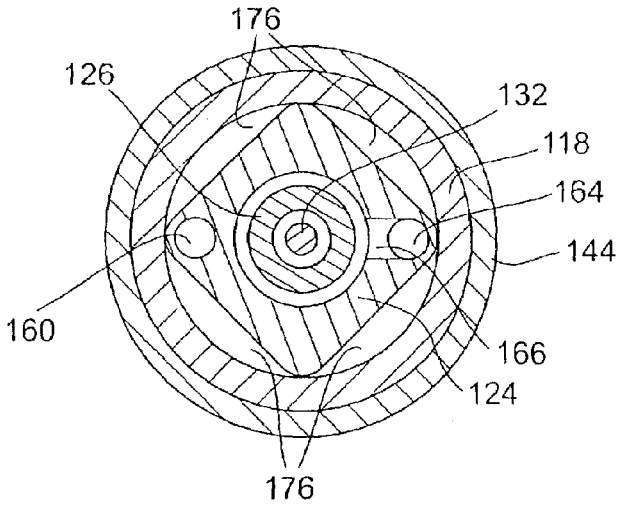
FIG. 8 is a cross-sectional view taken along the line 8—8 of FIG. 4A showing cross-sections of the pilot valve body, the lower pilot sleeve, and the pilot valve stem as contained in the engine mandrel. The well casing and the power fluid tubing are not shown in FIGS. 6, 7, and 8.

While all components of the invention are important, critical components include: pilot valve stem 132; reversing valve 116; upper valve sleeve 114; lower pilot sleeve 126; lower valve sleeve 110; pilot valve body 124; upper pilot sleeve 130; and actuator probe 142. The flow paths in upper valve sleeve 114; lower valve sleeve 110 and pilot valve body 124 are crucial to the operation of the invention. Accordingly cross-sectional reviews showing some of these components are shown in FIGS. 6, 7, and 8.

Of significance to the improved operation of the pump of this invention is, as has been previously mentioned, the configuration of reversing valve 116 and particularly the provision wherein the reversing valve has an intermediate flange 152. When the pump reaches its lower limits of travel to cause reversing valve 116 to immediately and positively move from its upper or second position to its first or lower position and in doing so, to reverse the direction of fluid pressure flow so that pressure is applied to the lower end of the engine piston to move it upwardly thereby move the pump piston upwardly to force produced fluid from the producing formation into the annular area 30 and thereby ultimately to the earth's surface.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A hydraulically actuated downhole pump comprising:

a power piston vertically reciprocated in a power cylinder;

a reversing valve carried with said power piston and serving, when in a first position, to direct fluid flow to force said piston upwardly in said cylinder and in a second position to provide bypass fluid flow to cause said piston to move downwardly in said cylinder;

a pilot valve carried by said power piston and having an upper and a lower position and serving when in said lower position to direct fluid flow to move said reversing valve from said first to said second position;

a probe fixedly secured relative to said cylinder and configured to move said pilot valve to said lower position when said piston reaches an upper limit of travel, wherein said probe includes a downwardly extending essentially closed conduit at its upper end and except for at least one orifice to control flow of hydraulic fluid as said piston reaches said upper limit of travel;

a pump cylinder in fixed and in coaxial relationship to said power cylinder;

a pump piston reciprocated within said power cylinder;

a pump rod interconnecting said power piston and said pump piston; and valves actuated in response to movement of said pump piston to cause pumping of fluid.

2. A hydraulically actuated downhole pump according to claim 1 including a reversing valve spool within said reversing valve and a pilot valve spool within said pilot valve, and wherein said reversing valve spool and said pilot valve spools are structurally uncoupled from each other.

3. A hydraulically actuated downhole pump according to claim 2 wherein said reversing valve is controlled in part by hydraulic action initiated by said pilot valve spool.

4. A hydraulically actuated downhole pump according to claim 3 wherein said reversing valve spool is controlled in part by a momentary change of positions of said pilot valve spool.

5. A hydraulically actuated downhole pump according to claim 1 wherein said reversing valve and said pilot valve are housed in a tubular engine mandrel in tandem coaxial relationship.

6. A hydraulically actuated downhole pump responsive to hydraulic pressure from fluid supply tubing that extends from the earth's surface, the pump having a piston vertically reciprocal between a top position and a bottom position in a cylinder, and an engine, formed as a part of said piston, to force fluid from an underground formation to the earth's surface upon upward movement of the piston and to permit fluid bypass as the piston moves downwardly in the cylinder said engine including:

a reversing valve carried with the pump piston having a first position and a second position, means in said first position to open passageways to direct fluid pressure from the fluid supply tubing to force the piston upwardly in the pump cylinder to said top position and when in said second position to open a flow channel to cause the piston to move downwardly;

a pilot valve carried with the pump piston having an upper and a lower position, the pilot valve having means to control flow passageways to hydraulically move said reversing valve from said first position to said second position; and an actuator probe within an upper portion of said pump having a downwardly extending essentially closed conduit at its upper end except for at least one orifice to control flow of hydraulic fluid as said engine approaches said top position and arranged to receive and move said pilot valve from said upper to said lower position when the piston reaches an upward travel limit and thereby cause said reversing valve to move from said first to said second position to thereby reverse the direction of travel of the piston to the downward direction.

7. A hydraulically actuated downhole pump according to claim 6 including a vertically positionable reversing valve spool within said reversing valve and a vertically positionable pilot valve spool, and wherein said reversing valve spool and said pilot valve spool are structurally independent of each other.

8. A hydraulically actuated downhole pump according to claim 7 wherein said reversing valve is controlled in part by hydraulic action initiated by positions of said pilot valve spool.

9. A hydraulically actuated downhole pump according to claim 8 wherein the position of said reversing valve spool is controlled in part by a momentary change of positions of said pilot valve spool.

10. A hydraulically actuated downhole pump according to claim 6 wherein said reversing valve and said pilot valve are in tandem coaxial relationship and housed in a tubular engine mandrel.

11. A hydraulically actuated downhole pump according to claim 6 wherein said engine includes an essentially square combined upper pilot valve body and a lower reversing valve sleeve defining an upper and a lower axial central passageway;

a plurality of spaced flow control openings in said reversing valve sleeve;

a first longitudinal passageway communicating from an opening in said upper central passageway of said pilot valve body with said lower central passageway above said flow control openings;

a second longitudinal passageway below said opening from said first longitudinal passageway communicating said upper central passageway of said pilot valve body with the bottom of said reversing valve sleeve;

said pilot valve being reciprocable to substantially open and close flow through said first and second longitudinal passageways;

said reversing valve being reciprocable to substantially open and close flow through said flow control openings in said reversing valve sleeve as a function of a position of said pilot valve.

* * * * *